US005653123A

United States Patent [19]

Handlin

[11] Patent Number: 5,653,123

[45] Date of Patent: Aug. 5, 1997

[54] QUICK COOL DEVICE

[76] Inventor: Rick Handlin, 2702 Reservoir Dr., Simi Valley, Calif. 93065

[21] Appl. No.: 665,360

[22] Filed: Jun. 17, 1996

[51] Int. Cl.[6] ..... F25D 3/08; F25D 25/02

[52] U.S. Cl. ..... 62/457.3; 62/381

[58] Field of Search ..... 62/457.1, 457.3, 62/457.8, 371, 62, 63, 381

[56] References Cited

U.S. PATENT DOCUMENTS

| | | | |
|---|---|---|---|
| 714,415 | 11/1902 | Trafford | 62/457.8 |
| 1,000,530 | 8/1911 | Magni | 62/457.8 |
| 2,736,174 | 2/1956 | Tice | 62/457.1 |
| 4,549,409 | 10/1985 | Smith | 62/457.1 |
| 4,580,405 | 4/1986 | Cretzmeyer | 62/63 |

*Primary Examiner*—William Doerrler
*Attorney, Agent, or Firm*—Michael I. Kroll

[57] ABSTRACT

A quick cool device (10) for a beverage can (12) comprising a housing (14). A twist member (16) is rotatively carried in the housing (14). The twist member (16) has a handle (18) extending up through a top of the housing A facility (20) is for allowing rotation of the twist member (16) in one direction within the housing (14). A gear assembly (22) is in the housing (14). A component (24) is connected between the twist member (16) and the gear assembly (22) in the housing (14), for storing energy when the handle (18) of the twist member (16) is manually turned. A holder (26) for the beverage can (12) is connected to the gear assembly (22) on bottom of the housing (14). An assemblage (28) is for locking and unlocking the gear assembly (22). When the gear assembly (22) is locked the energy storing component (24) will store energy. When the gear assembly (22) is unlocked, the energy storing component (24) will release the stored energy to cause the gear assembly (22) to rotate the holder (26), thereby allowing the beverage can (12) to rotate within pieces of ice (30) in an ice chest (31) to cool off the beverage can (12) quickly.

23 Claims, 3 Drawing Sheets

QUICK COOL DEVICE

BACKGROUND OF THE INVENTION

1. Field of the Invention

The instant invention relates generally to cooling apparatuses and more specifically it relates to a quick cool device.

2. Description of the Prior Art

Numerous cooling apparatuses have been provided in prior art that are adapted to reduce the temperatures of various articles over a long period of time. While these units may be suitable for the particular purpose to which they address, they would not be as suitable for the purposes of the present invention as heretofore described.

SUMMARY OF THE INVENTION

A primary object of the present invention is to provide a quick cool device that will overcome the shortcomings of the prior art devices.

Another object is to provide a quick cool device that will cool off a beverage can at room temperature to around freezing in a short amount of time, by covering the beverage can in pieces of ice within an ice chest and letting the beverage can spin about in the ice.

An additional object is to provide a quick cool device that will cool off the beverage can quickly, thereby saving room in the ice chest for food items that must stay cold all the time, such as mayonnaise, meat, etc.

A further object is to provide a quick cool device that is simple and easy to use.

A still further object is to provide a quick cool device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
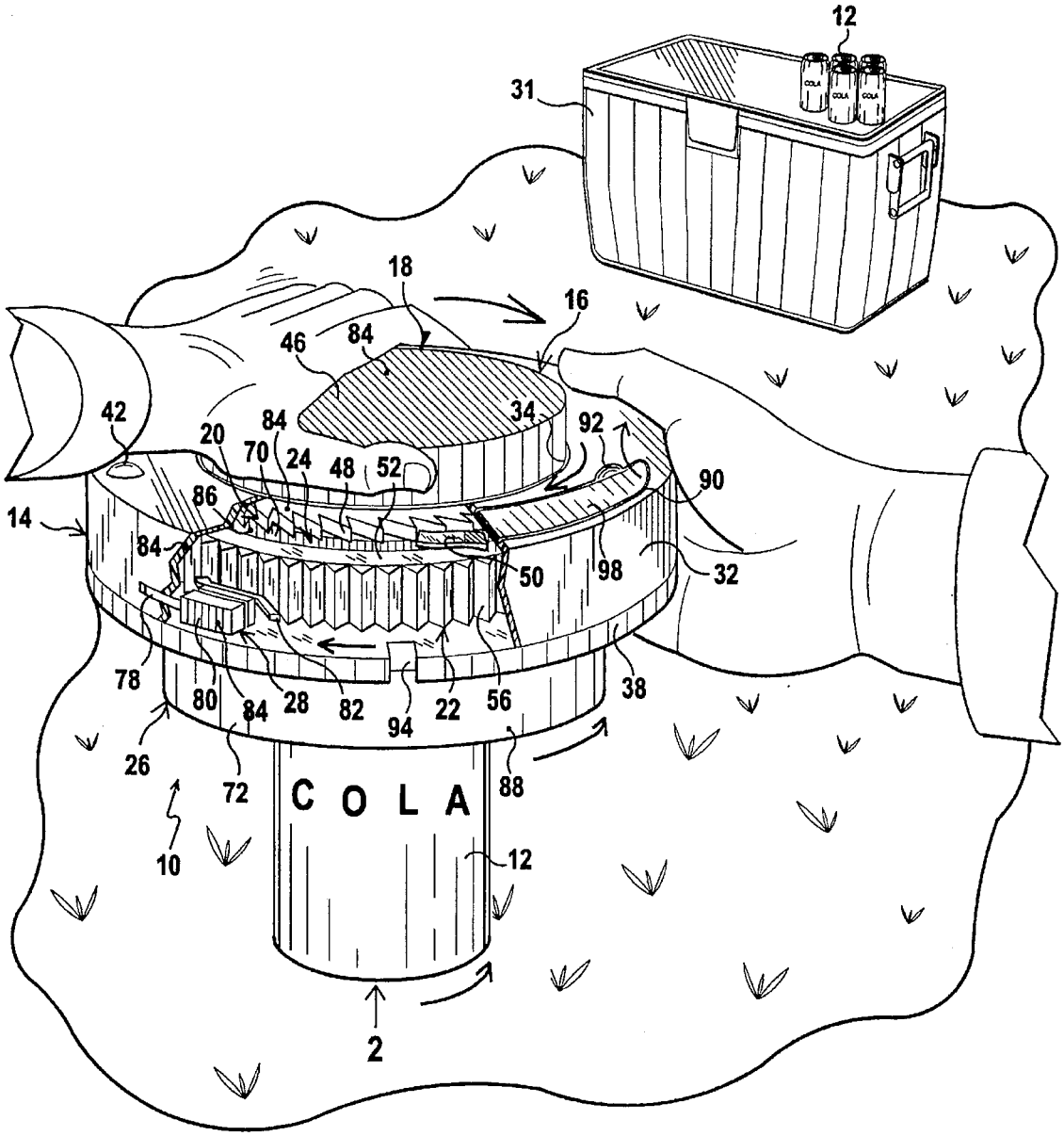
FIG. 1 is a top perspective view of the instant invention with parts broken away, showing two hands of a person winding it up adjacent an ice chest.
Figure 2:
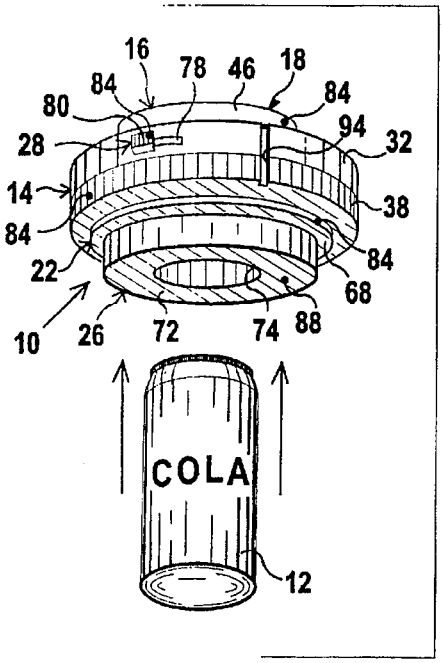
FIG. 2 is a bottom perspective view of the instant invention taken in the direction of arrow 1 in FIG. 2, showing a beverage can ready to be inserted into the holder.
Figure 3:
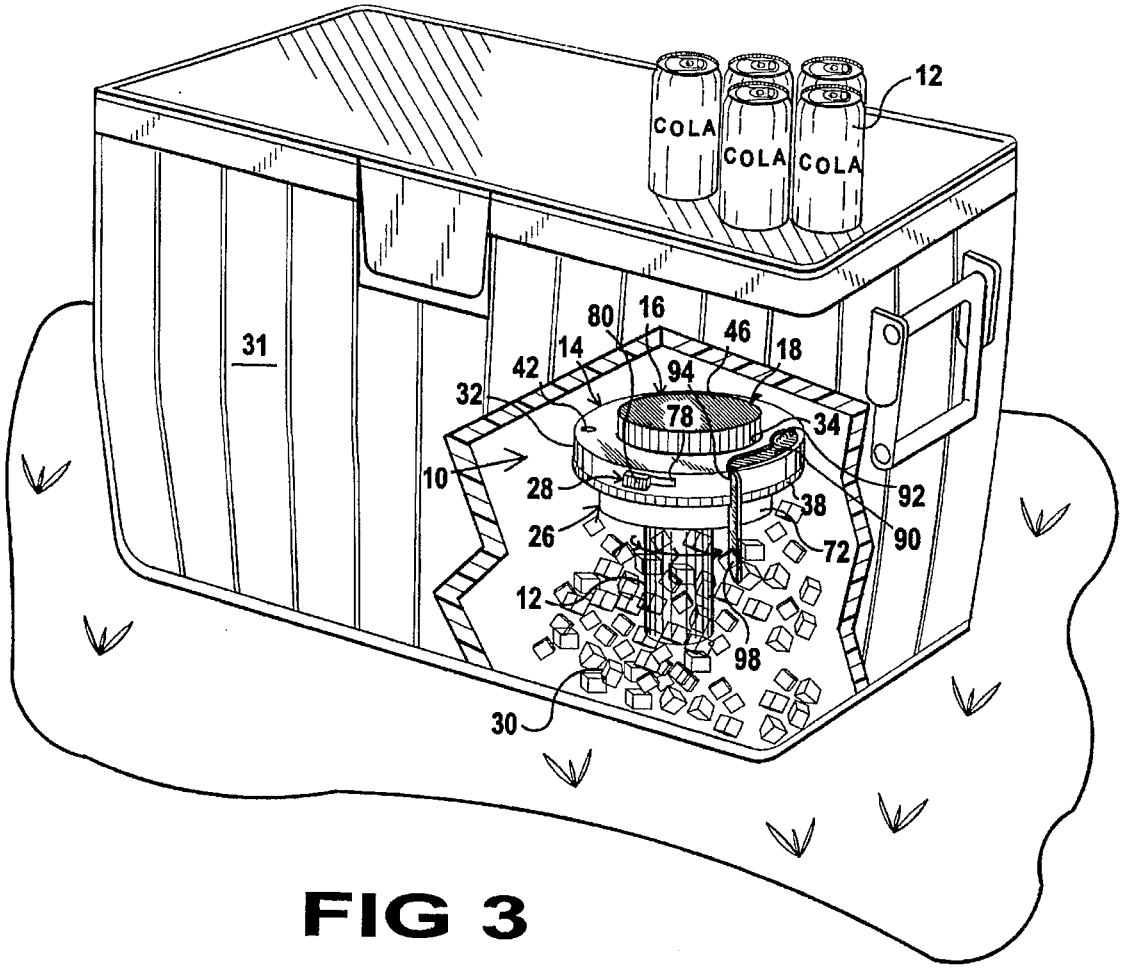
FIG. 3 is a top perspective view of the ice chest with parts broken away, showing the instant invention spinning the beverage can about ice within the ice chest.

Turning now descriptively to the drawings, in which similar reference characters denote similar elements throughout the several views, FIGS. 1 through 6 illustrate a quick cool device 10 for a beverage can 12 comprising a housing 14. A twist member 16 is rotatively carried in the housing 14. The twist member 16 has a handle 18 extending up through a top of the housing 14. A facility 20 is for allowing rotation of the twist member 16 in one direction within the housing 14. A gear assembly 22 is in the housing 14. A component 24 is connected between the twist member 16 and the gear assembly 22 in the housing 14, for storing energy when the handle 18 of the twist member 16 is manually turned.

A holder 26 for the beverage can 12 is connected to the gear assembly 22 on the bottom of the housing 14. An assemblage 28 is for locking and unlocking the gear assembly 22. When the gear assembly 22 is locked, the energy storing component 24 will store energy. When the gear assembly 22 is unlocked, the energy storing component 24 will release the stored energy to cause the gear assembly 22 to rotate the holder 26, thereby allowing the beverage can 12 to rotate within pieces of ice 30 in an ice chest 31, to cool off the beverage can 12 quickly.

The housing 14 includes an upper cylindrical shell 32 having a central aperture 34 therethrough and a plurality of holes 36 radially positioned about the central aperture 34. A lower cylindrical base 38 has a plurality of threaded bosses 40 radially positioned thereon. A plurality of mounting screws 42 are provided. Each mounting screw 42 fits through one hole 36 in the upper cylindrical shell 32 and threads into one threaded boss 40 on the lower cylindrical base 38. The upper cylindrical shell 32 can also be fastened to the lower cylindrical base 38 by heat treatment.

The twist member 16 is a cylindrical body 44, while the handle 18 is an enlarged head 46. The rotation allowing facility 20 consists of a ratchet ring 48 integral with the twist member 16. A pawl 50 is affixed to the housing 14, to engage with the ratchet ring 48, so that the ratchet ring 48 will only turn in one direction.

Figure 4:
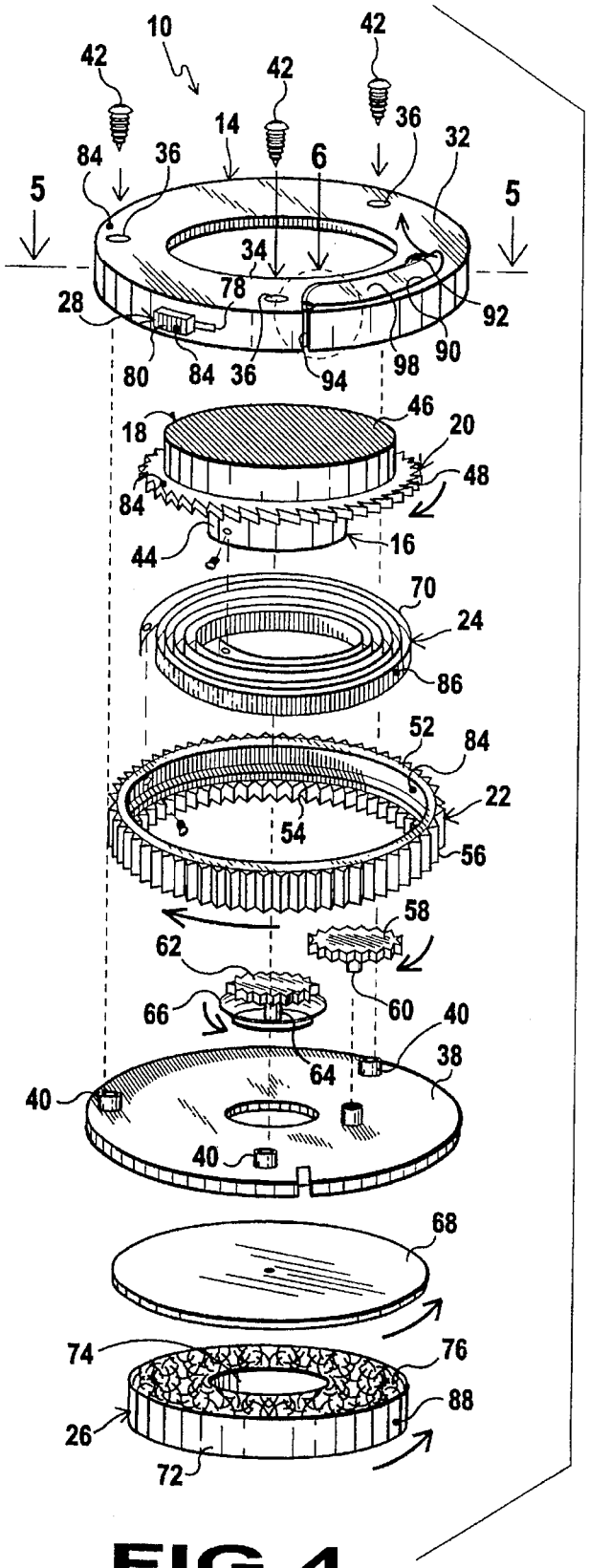
FIG. 4 is an exploded top perspective view of the instant invention, showing the internal elements in greater detail.
Figure 5:
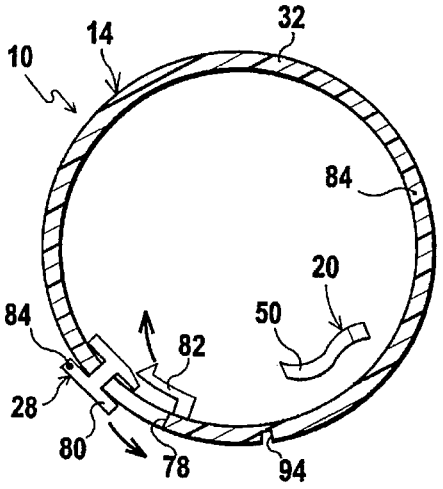
FIG. 5 is a cross sectional view taken along line 5—5 in FIG. 4 through the upper cylindrical shell of the housing, showing the pawl, slide button and flexible arm therein.

The gear assembly 22, as best seen in FIG. 4, comprises a spur gear ring 52 having internal teeth 54 and external teeth 56. An offset pinion gear 58 has a shaft 60 rotatively mounted in the housing 14. The offset pinion gear 58 is in engagement with the internal teeth 54 of the spur gear ring 52. A central pinion gear 62 has a shaft 64 in a dish 66 mounted centrally in the bottom of housing 14. The central pinion gear 62 is in engagement with the offset pinion gear 58. A cylindrical plate 68 is centrally connected to the shaft 64 of the central pinion gear 62 below the bottom of housing 14.

The energy storing component 24 is a flat spiral spring 70. An inner end of the flat spiral spring 70 is connected to the twist member 16. The outer end of the flat spiral spring 70 is connected to the spur gear ring 52 of the gear assembly 22.

The holder 26 is a flexible disc 72 having a central opening 74 to receive a top end of the beverage can 12. The flexible disc 72 is connected to the cylindrical plate 68 of the gear assembly 22 by adhesive 76 or heat treatment. The locking and unlocking means assemblage 28 includes the housing 14 having a side slot 78 therethrough. A slide button 80 is carried in the side slot 78 of the housing 14.

A flexible arm 82 is affixed to the interior of the housing 14 adjacent the slide button 80. When the slide button 80 is manually moved in the side slot 78 in a first direction, it will push the flexible arm 82 inwardly to engage with the external teeth 56 of the spur gear ring 52 of the gear assembly 22, to prevent rotation of the spur gear ring 22. When the slide button 80 is manually moved in the side slot 78 in an opposite direction, it will allow the flexible arm 82 to disengage from the external teeth 56 of the spur gear ring 52 of the gear assembly 22, to allow rotation of the spur gear ring 22.

The housing 14, the twist member 16, the rotation allowing facility 20, the gear assembly 22 and the locking and unlocking assemblage 28 are all fabricated out of durable strong plastic material 84, such as plastic, thin metal or composite matter. The energy storing component 24 is fabricated out of a strong flexible material 86, such as stainless steel or plastic. The holder 26 is fabricated out of a compressible material 88, such as rubber, foam or composite matter.

Figure 6:
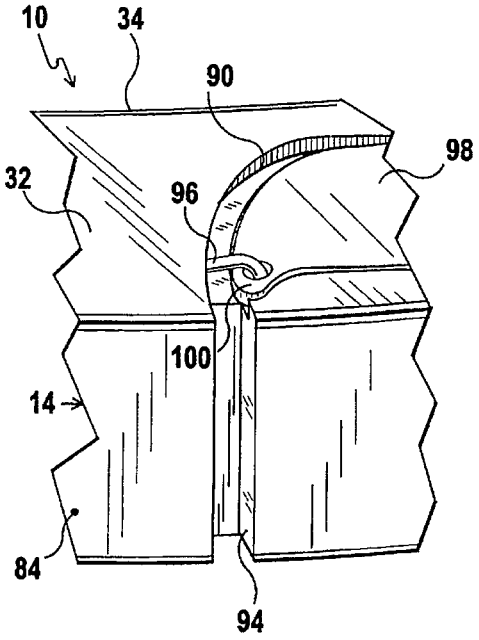
FIG. 6 is an enlarged perspective view of the area in FIG. 4 indicated by arrow 6.

The housing 14 has a top recessed area 90, with a finger grip opening 92 and a cooperating vertical side slot 94. A hinge rod 96, as best seen in FIG. 6, is at the intersection of the top recessed area 90 and the vertical side slot 94. A flat projection member 98 is provided, having a lug 100 to engage with the hinge rod 96. When the flat projection member 98 is not used, it will rest in the top recessed area 90. When the flat projection member is used, it will be lifted out of the top recessed area 90 at the finger grip opening 92, placed within the vertical slide slot 94 in the housing 14 and held in position thereto by the hinge rod 96, to keep the device 10 stationary when the beverage can 12 rotates within the pieces of ice 30 in the ice chest 31.

LIST OF REFERENCE NUMBERS 10 quick cool device
12 beverage can
14 housing of 10
16 twist member of 10
18 handle on 16
20 rotation allowing facility of 10
22 gear assembly of 10
24 energy storing component of 10
26 holder of 10 for 12
28 locking and unlocking assemblage of 10
30 piece of ice
31 ice chest
32 upper cylindrical shell of 14
34 central aperture in 32
36 hole in 32
38 lower cylindrical base of 14
40 threaded boss on 38
42 mounting screw
44 cylindrical body for 16
46 enlarged head for 18
48 ratchet ring of 20 on 16
50 pawl of 20 on 14
52 spur gear ring of 22
54 internal teeth of 52
56 external teeth of 52
58 offset pinion gear of 22
60 shaft of 58
62 central pinion gear of 22
64 shaft of 62
66 dish of 62
68 cylindrical plate of 22
70 flat spiral spring for 24
72 flexible disc for 26
74 central opening in 72
76 adhesive between 72 and 68
78 side slot in 14 of 28
80 slide button of 28
82 flexible arm of 28
84 durable strong material for 14, 16, 20, 22 and 28
86 strong flexible material for 24
88 compressible material for 26
90 top recessed area in 14
92 finger grip opening at 90
94 vertical side slot in 14
96 hinge rod at 90 and 94
98 flat projection member
100 lug on 98

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A quick cool device for a beverage can comprising:

a) a housing;

b) a twist member rotatively carried in said housing, said twist member having a handle extending up through a top of said housing;

c) means for allowing rotation of said twist member in one direction within said housing;

d) a gear assembly in said housing;

e) means connected between said twist member and said gear assembly in said housing, for storing energy when said handle of said twist member is manually turned;

f) a holder for the beverage can connected to said gear assembly on bottom of said housing; and g) means for locking and unlocking said gear assembly, so that when said gear assembly is locked said energy storing means will store energy and when said gear assembly is unlocked said energy storing means will release the stored energy to cause said gear assembly to rotate said holder, thereby allowing the beverage can to rotate within pieces of ice to cool off the beverage can quickly.

2. A quick cool device as recited in claim 1, wherein said housing includes:

a) an upper cylindrical shell having a central aperture therethrough and a plurality of holes radially positioned about said central aperture;

b) a lower cylindrical base having a plurality of threaded bosses radially positioned thereon; and c) a plurality of mounting screws, in which each said mounting screw fits through one said hole in said upper cylindrical shell and threads into one said threaded boss on said lower cylindrical base.

3. A quick cool device as recited in claim 1, wherein said twist member is a cylindrical body, while said handle is an enlarged head.

4. A quick cool device as recited in claim 1, wherein said rotation allowing means includes:

a) a ratchet ring integral with said twist member; and b) a pawl affixed to said housing to engage with said ratchet ring, so that said ratchet ring will only turn in one direction.

5. A quick cool device as recited in claim 1, wherein said gear assembly includes:

a) a spur gear ring having internal teeth and external teeth;

b) an offset pinion gear having a shaft rotatively mounted in said housing, with said offset pinion gear in engagement with said internal teeth of said spur gear ring;

c) a central pinion gear having a shaft in a dish mounted centrally in bottom of said housing, with said central pinion gear in engagement with said offset pinion gear; and d) a cylindrical plate centrally connected to said shaft of said central pinion gear below bottom of said housing.

6. A quick cool device as recited in claim 1, wherein said energy storing means is a flat spiral spring, in which an inner end of said flat spiral spring is connected to said twist member, while said outer end of said flat spiral spring is connected to a spur gear ring of said gear assembly.

7. A quick cool device as recited in claim 1, wherein said holder is a flexible disc having a central opening to receive a top end of the beverage can, whereby said flexible disc is connected to a cylindrical plate of said gear assembly.

8. A quick cool device as recited in claim 1, wherein said locking and unlocking means includes:

a) said housing having a side slot therethrough;

b) a slide button carried in said side slot of said housing; and c) a flexible arm affixed to the interior of said housing adjacent said slide button, so that when said slide button is manually moved in said side slot in a first direction, it will push said flexible arm inwardly to engage with external teeth of a spur gear ring of said gear assembly, to prevent rotation of said spur gear ring and when said slide button is manually moved in said side slot in an opposite direction, it will allow said flexible arm to disengage from said external teeth of said spur gear ring of said gear assembly, to allow rotation of said spur gear ring.

9. A quick cool device as recited in claim 1, wherein said housing, said twist member, said rotation allowing means, said gear assembly and said locking and unlocking means are all fabricated out of durable strong material.

10. A quick cool device as recited in claim 1, wherein said energy storing means is fabricated out of a strong flexible material.

11. A quick cool device as recited in claim 1, wherein said holder is fabricated out of compressible material.

12. A quick cool device as recited in claim 1, further including:

a) said housing having a top recessed area with a finger grip opening and a cooperating vertical side slot;

b) a hinge rod at intersection of said top recessed area and said vertical side slot;

c) a flat projection member having a lug to engage with said hinge rod, so that when said flat projection member is not used it will rest in said top recessed area and when said flat projection member is used it will be lifted out of said top recessed area at said finger grip opening, placed within said vertical side slot in said housing and held in position thereto by said hinge rod, to keep said device stationary while the beverage can rotates within the pieces of ice.

13. A quick cool device for a beverage can comprising:

a) a housing including an upper cylindrical shell having a central aperture therethrough and a plurality of holes radially positioned about said central aperture, a lower cylindrical base having a plurality of threaded bosses radially positioned thereon and a plurality of mounting screws, in which each said mounting screw fits through one said hole in said upper cylindrical shell and threads into one said threaded boss on said lower cylindrical base;

b) a twist member rotatively carried in said housing, said twist member having a handle extending up through a top of said housing;

c) means for allowing rotation of said twist member in one direction within said housing;

d) a gear assembly in said housing;

e) means connected between said twist member and said gear assembly in said housing, for storing energy when said handle of said twist member is manually turned;

f) a holder for the beverage can connected to said gear assembly on bottom of said housing; and g) means for locking and unlocking said gear assembly, so that when said gear assembly is locked said energy storing means will store energy and when said gear assembly is unlocked said energy storing means will release the stored energy to cause said gear assembly to rotate said holder, thereby allowing the beverage can to rotate within pieces of ice to cool off the beverage can quickly.

14. A quick cool device as recited in claim 13, wherein said twist member is a cylindrical body, while said knob is an enlarged cylindrical head.

15. A quick cool device as recited in claim 14, wherein said rotation allowing means includes:

a) a ratchet ring integral with said twist member; and b) a pawl affixed to said housing to engage with said ratchet ring, so that said ratchet ring will only turn in one direction.

16. A quick cool device as recited in claim 15, wherein said gear assembly includes:

a) a spur gear ring having internal teeth and external teeth;

b) an offset pinion gear having a shaft rotatively mounted in said housing, with said offset pinion gear in engagement with said internal teeth of said spur gear ring;

c) a central pinion gear having a shaft in a dish mounted centrally in bottom of said housing, with said central pinion gear in engagement with said offset pinion gear; and d) a cylindrical plate centrally connected to said shaft of said central pinion gear below bottom of said housing.

17. A quick cool device as recited in claim 16, wherein said energy storing means is a flat spiral spring, in which an inner end of said flat spiral spring is connected to said twist member, while said outer end of said flat spiral spring is connected to a spur gear ring of said gear assembly.

18. A quick cool device as recited in claim 17, wherein said holder is a flexible disc having a central opening to receive a top end of the beverage can, whereby said flexible disc is connected to said cylindrical plate of said gear assembly.

19. A quick cool device as recited in claim 18, wherein said locking and unlocking means includes:

a) said housing having a side slot therethrough;

b) a slide button carried in said side slot of said housing; and c) a flexible arm affixed to the interior of said housing adjacent said slide button, so that when said slide button is manually moved in said side slot in a first direction, it will push said flexible arm inwardly to engage with said external teeth of said spur gear ring of said gear assembly, to prevent rotation of said spur gear ring and when said slide button is manually moved in said side slot in an opposite direction, it will allow said flexible arm to disengage from said external teeth of said spur gear ring of said gear assembly, to allow rotation of said spur gear ring.

20. A quick cool device as recited in claim 19, wherein said housing, said twist member, said rotation allowing means, said gear assembly and said locking and unlocking means are all fabricated out of durable strong material.

21. A quick cool device as recited in claim 20, wherein said energy storing means is fabricated out of a strong flexible material.

22. A quick cool device as recited in claim 21, wherein said holder is fabricated out of a compressible material.

23. A quick cool device as recited in claim 22, further including:

a) said housing having a top recessed area with a finger grip opening and a cooperating vertical side slot;

b) a hinge rod at intersection of said top recessed area and said vertical side slot;

c) a flat projection member having a lug to engage with said hinge rod, so that when said flat projection member is not used it will rest in said top recessed area and when said flat projection member is used it will be lifted out of said top recessed area at said finger grip opening, placed within said vertical side slot in said housing and held in position thereto by said hinge rod, to keep said device stationary while the beverage can rotates within the pieces of ice.

* * * * *